US010228209B2

(12) United States Patent
Newman

(10) Patent No.: US 10,228,209 B2
(45) Date of Patent: Mar. 12, 2019

(54) NON-SEGMENTED COMPOSITE BARREL FOR GAS OPERATED FIREARMS

(71) Applicant: Cory J. Newman, Providence, UT (US)

(72) Inventor: Cory J. Newman, Providence, UT (US)

( * ) Notice: Subject to any disclaimer, the term of this patent is extended or adjusted under 35 U.S.C. 154(b) by 0 days.

(21) Appl. No.: 15/654,144

(22) Filed: Jul. 19, 2017

(65) Prior Publication Data

US 2018/0023913 A1 Jan. 25, 2018

Related U.S. Application Data

(60) Provisional application No. 62/364,203, filed on Jul. 19, 2016.

(51) Int. Cl.

| | |
|---|---|
| ***F41A 21/02*** | (2006.01) |
| ***F41A 21/04*** | (2006.01) |
| ***F41A 5/26*** | (2006.01) |

(52) U.S. Cl.

CPC ..... *F41A 21/04* (2013.01); *F41A 5/26* (2013.01); *F41A 21/02* (2013.01)

(58) Field of Classification Search

CPC ..... F41A 21/02; F41A 21/04

USPC ..... 42/76.02, 76.1, 76.01, 78

See application file for complete search history.

(56) References Cited

U.S. PATENT DOCUMENTS

| | | | | |
|---|---|---|---|---|
| 2,847,786 | A * | 8/1958 | Day | F41A 21/02 138/DIG. 2 |
| 4,685,236 | A * | 8/1987 | May | F41A 21/02 42/76.02 |
| 5,692,334 | A * | 12/1997 | Christensen | F41A 21/02 42/76.02 |
| 5,804,756 | A * | 9/1998 | Christensen | F41A 21/02 42/76.02 |
| 8,333,029 | B1 * | 12/2012 | Noveske | C23C 8/02 42/76.1 |
| 2004/0244257 | A1 * | 12/2004 | Degerness | F41A 21/02 42/76.02 |
| 2006/0265926 | A1 * | 11/2006 | Sietsema | F41A 21/04 42/76.02 |
| 2011/0173864 | A1 * | 7/2011 | Christensen | F41A 21/02 42/78 |
| 2016/0334180 | A1 * | 11/2016 | Curliss | F41A 21/02 |

* cited by examiner

*Primary Examiner* — Reginald S Tillman, Jr.
(74) *Attorney, Agent, or Firm* — Dobbin IP Law P.C.; Geoffrey E. Dobbin

(57) ABSTRACT

A method of making a continuous fiber barrel wrap sheath onto a steel riffled barrel liner of a gas-operated firearm is described. A wrap made up of composite fiber is wrapped onto a steel riffled barrel liner in a continuous fashion, with no interruption within the steel liner for the purpose of delivering high pressure gas through the steel liner. After joining the composite wrap to the steel barrel liner, either by mechanical or chemical procedure, a slot is formed by carving out a top and/or a bottom of the composite. A gas key insert is then placed in the made slots and retained by mechanical or chemical procedure. Finally, a gas port is drilled through the key insert.

18 Claims, 5 Drawing Sheets

NON-SEGMENTED COMPOSITE BARREL FOR GAS OPERATED FIREARMS

CROSS-REFERENCES TO RELATED APPLICATIONS

This application claims priority based on prior file U.S. Provisional Application No. 62/364,203, filed Jul. 19, 2016, and incorporated the same by reference herein in its entirety.

FIELD OF THE INVENTION

The embodiments herein relate generally firearms and more particularly to a method of making a non-segmented, continuous, fiber-wrap sheath over a steel riffled barrel liner for a gas-operated firearm.

BACKGROUND OF THE INVENTION

Since the advent of the firearm, mankind has expended great effort in making firearms lighter and easier to use. The difficulty in this effort is that, by nature, a firearm must contain a controlled explosion of a propellant charge, such as gunpowder, to launch a projectile with usually lethal force. Even at this time, only metals can be readily relied upon to contain these repeated explosions. As such, firearm barrels are most often made of metals.

One method of making barrels lighter, especially as developments in both metallurgy and propellants advances, is to make a steel barrel liner and then wrap it in some form of composite outer layer, usually fiberglass or reinforced polymer. Prior to embodiments of the disclosed invention the steel barrel liners were wrapped with composite fibers in divided segments. Divided segments permit a location in which to create a gas port for the extraction of hot, high-pressure gas from the fired cartridge to power the mechanism of ejection and reloading of the system. High-temperature gasses can degrade the composite structure if not ported completely through the steel. Unfortunately, by using divided segments, at least one hinge point is created which adversely affects the barrel weight, strength, and accuracy of the firearm. Embodiments of the disclosed invention solve this problem.

SUMMARY OF THE INVENTION

A method of making a continuous fiber barrel wrap sheath onto a steel rifled barrel liner of a gas-operated firearm is described. A wrap made of composite fiber is wrapped onto a steel riffled barrel liner in a continuous fashion from near chamber end to near muzzle end with no interruption within the steel liner. After joining the composite wrap to the steel barrel liner, either by mechanical or chemical procedures, one or more slots are formed by carving out a top and/or a bottom of the composite. A gas key insert is then placed in the made slots and retained by mechanical or chemical procedure. Finally, a gas port is drilled through at least one key insert.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF CERTAIN EMBODIMENTS

Figure 1:
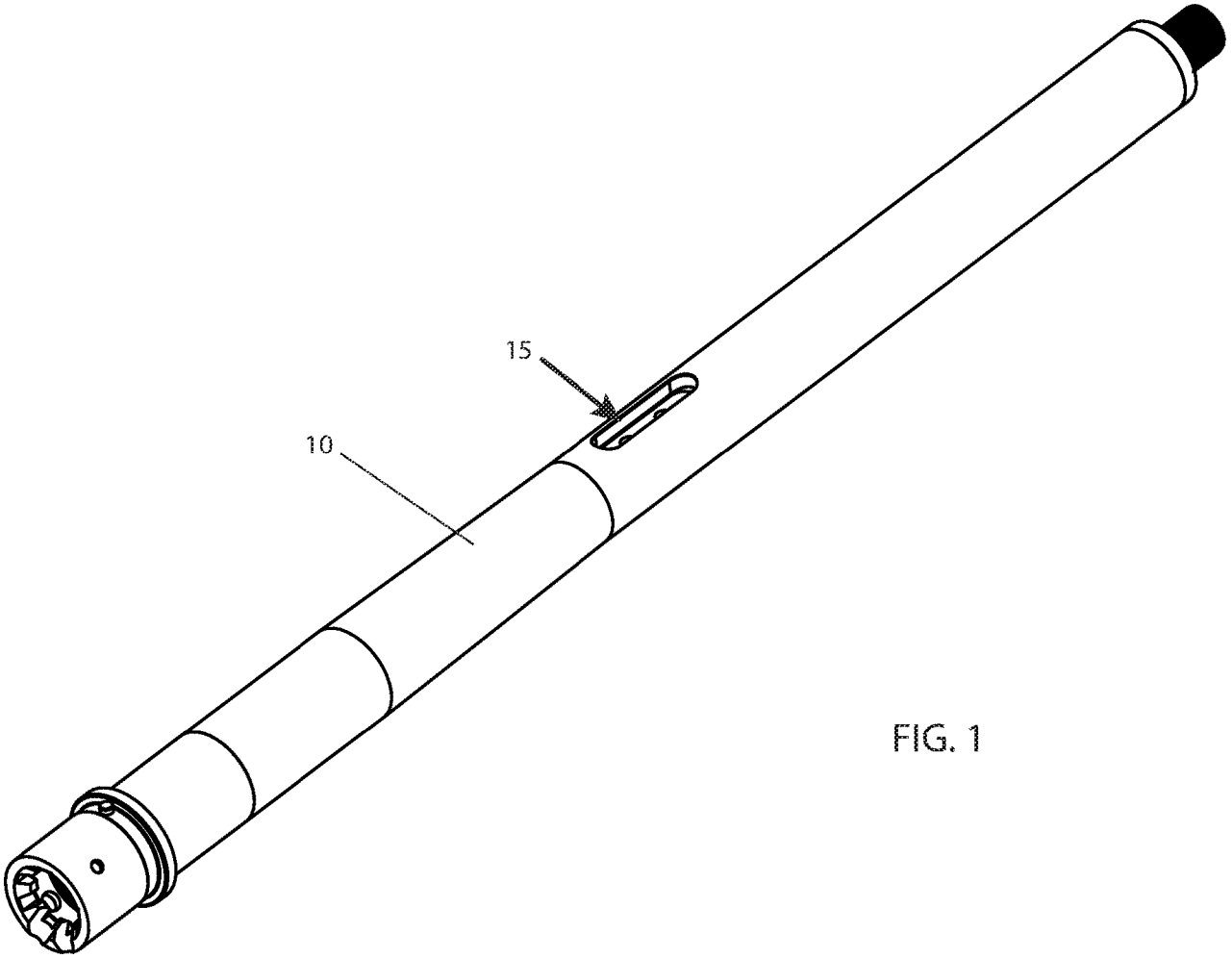
FIG. 1 is a perspective view of a gun barrel constructed according to the teachings of at least one embodiment of the invention.
Figure 2:
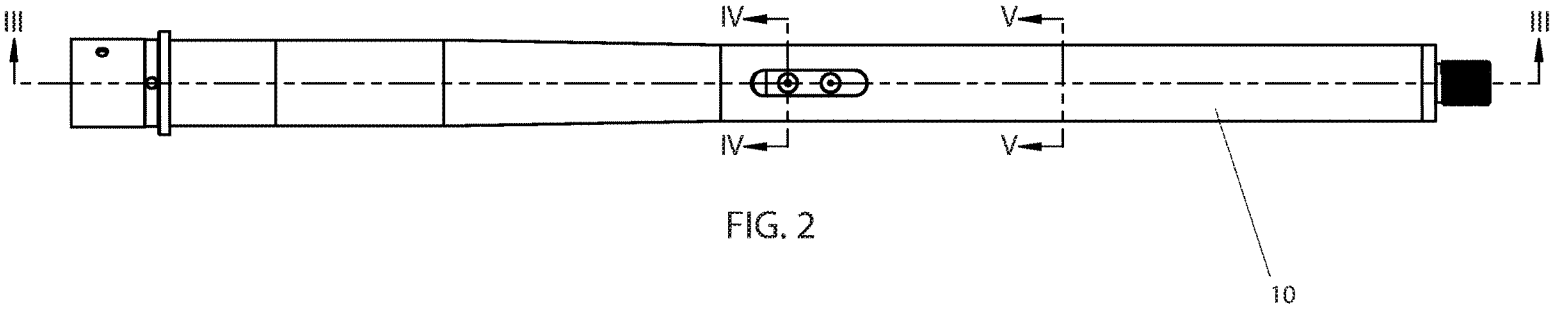
FIG. 2 is a top plan view of the gun barrel of FIG. 1.

With reference now to the drawings, a preferred embodiment of the composite barrel is herein described. It should be noted that the articles "a", "an", and "the", as used in this specification, include plural referents unless the content clearly dictates otherwise. The following reference numerals are used throughout the specification to denote the following components in all of the drawings:

10—Composite Barrel;
11—Contoured, Rifled Barrel (inner liner);
12—Corrosion Insulative Barrier;
13—Polymer Matrix Composite Shell;
14—Composite Aesthetic Skin Covering;
15—Key Insert Pockets;
16—Gas Key Insert
17—Gas Key Fasteners
18—Gas Port
19—Barrel Axis
20—Gas Block
21—Flash Suppressor With reference to FIGS. 1-5, a barrel 10 is made by having a continuous barrel wrap 13 placed upon a barrel liner 11 and covered with a polymer covering 14. A corrosion resistant layer 12 is first applied to the barrel liner, before wrapping. The wrap 13 may comprise composite fiber that is wrapped onto a steel rifled barrel liner in a continuous fashion from chamber end to muzzle end, forming a rigid composite sheath. After joining the wrap to the steel barrel, either by mechanical or chemical procedure, a slot 15 is formed by carving out a top and/or the bottom of the composite wrap. A gas key insert 16 is then placed in the created slots 15 via a mechanical 17 or chemical procedure or both. Finally, a gas port 18 is drilled through the key insert 16. Resulting in a rigid, continuous composite fiber sheath running the longitudinal length of the barrel around the gas keys.

Figure 6:
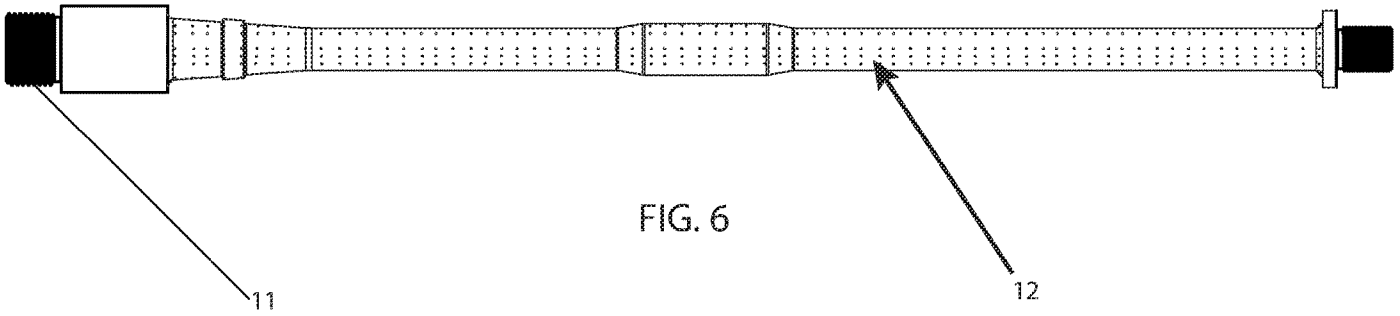
FIG. 6 is a side elevation of a coated gun barrel liner, which may be used in constructing a gun barrel according to the present invention.

Turning to these steps in more detail and in some embodiments, it is useful to provide a corrosion preventative layer 12 between the barrel liner 11 and composite sheath 13 (FIG. 6). The layer 12 may be any material which would appropriately coat the barrel liner 11 before application of the sheath 13. The protective layer 12 should cover all the barrel liner 11 from the muzzle to the chamber ends such that the sheath 13 never actually makes contact with the barrel liner 11.

A composite fiber sheath 13 with unidirectional or multidirectional fiber placement is wrapped around a steel barrel liner 11. The sheath 13 can also be wrapped around a mandrel and later pressed onto the barrel. The sheath 13 is wrapped in a continuous fashion to avoid adding weight from a segmented steel liner and to increase the rigidity of the overall device. Thus, the continuous wrapping provides longitudinal strength to the steel liner 11, and maximizing structure harmonics which are advantageous to accuracy of the barrel 10. Carbon fiber is a preferred material for the sheath 14, though any other sufficiently light and strong material may be used.

Figure 7:
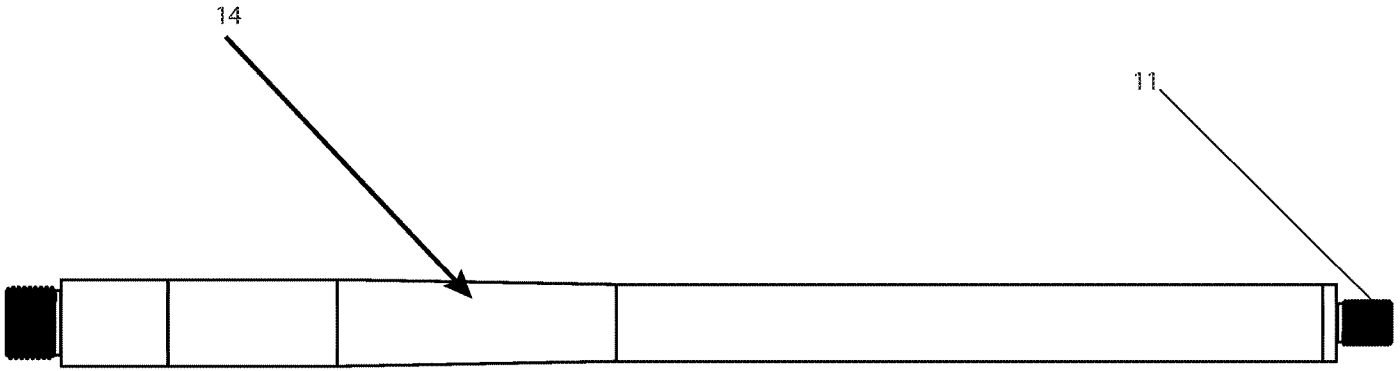
FIG. 7 is a side elevation of the gun barrel liner of FIG. 6, finished.

When finished wrapping, a final aesthetic layer 14 should be applied to the sheath 13. This final layer 14 may also add to the structural integrity of the barrel 10 and may also provide additional weather proofing. The aesthetic layer 14 may also take any form, color or texture that may be readily applied to the composite barrel 10 (FIG. 7).

A slot 15 is carved out on the top and/or the bottom sides of the composite through the aesthetic layer 14, sheath 13, corrosion layer 12, and partially in the steel barrel liner 11. The slot 15 may measure anywhere from ⅛-inch wide to ⅜-inch wide and between ½-inch long to three inches long, whatever is sufficient to receive a gas key insert 16. By forming slot 15 in the barrel, the hinge point caused by the use of divided segments is avoiding; thus improving the efficiency of the firearm by introducing longitudinal stiffness and harmonic dampening of vibrations.

Figure 3:
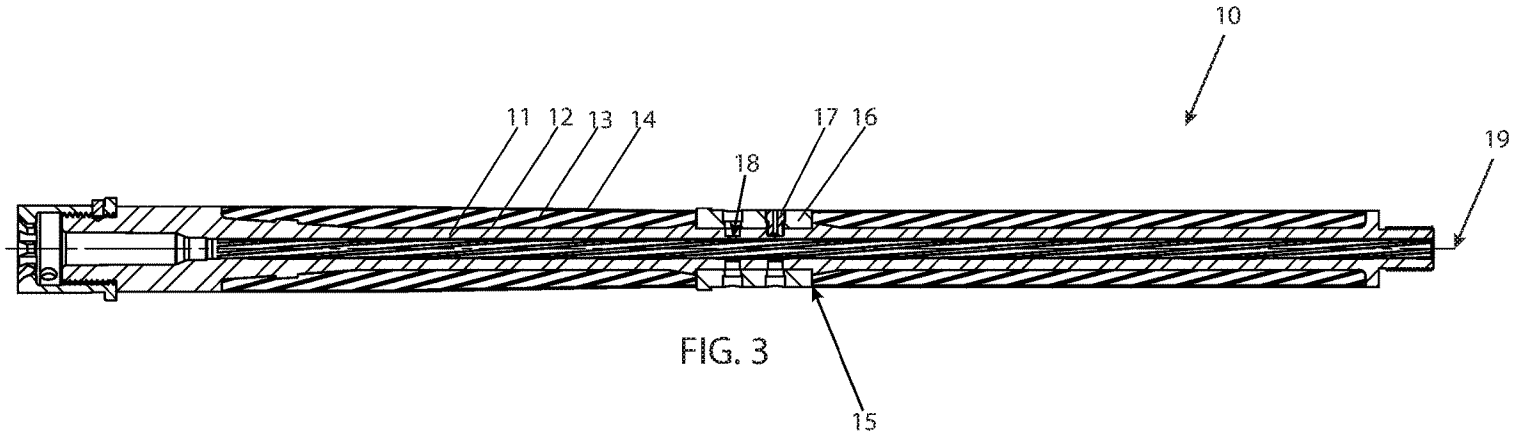
FIG. 3 is a sectional view of the gun barrel in FIG. 2, taken along line III.
Figure 5:
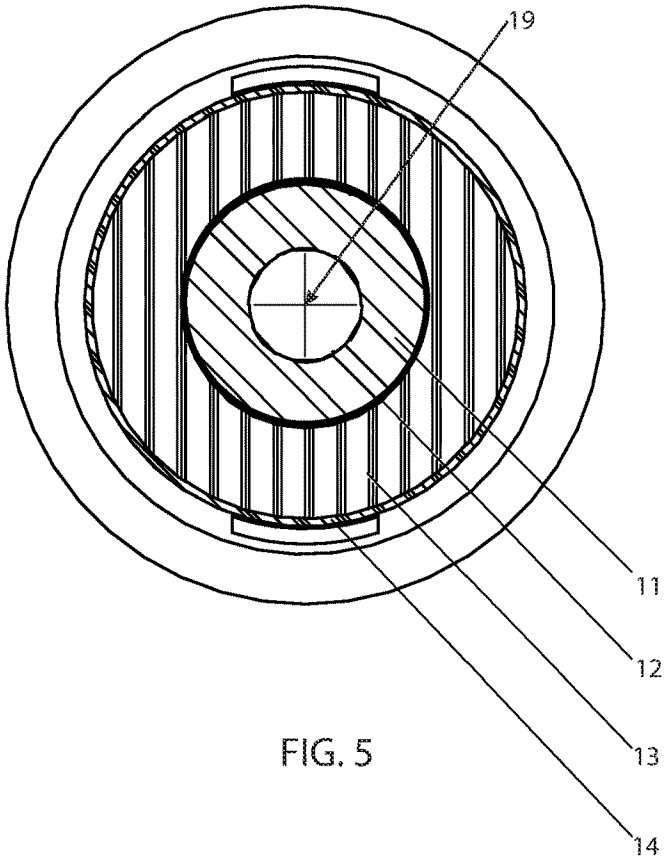
FIG. 5 is a sectional view of the gun barrel in FIG. 2, taken along line V.
Figure 4:
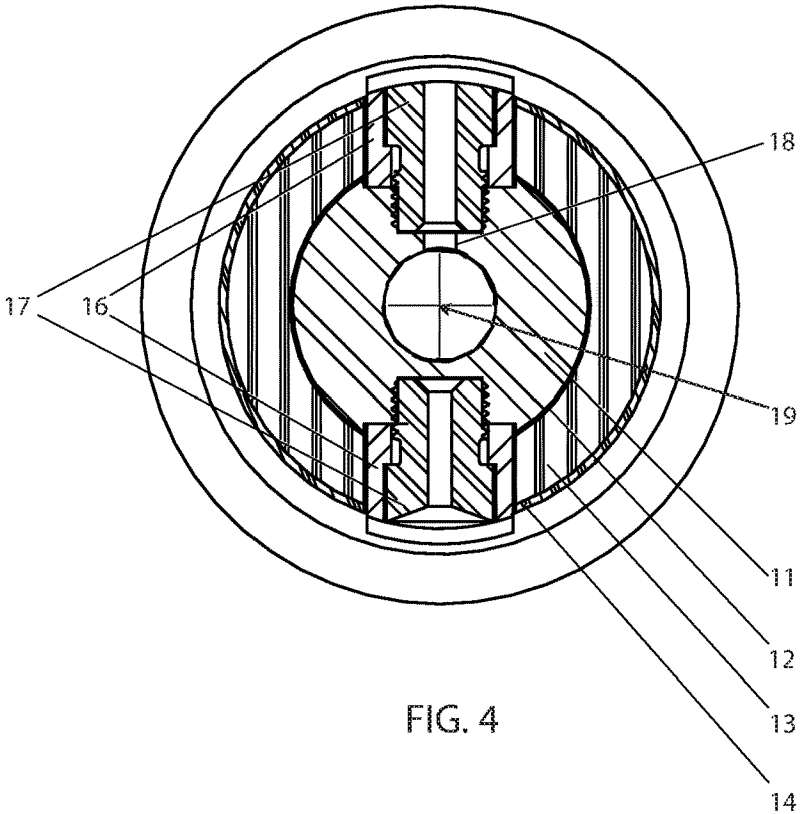
FIG. 4 is a sectional view of the gun barrel in FIG. 2, taken along line IV.
Figure 8:
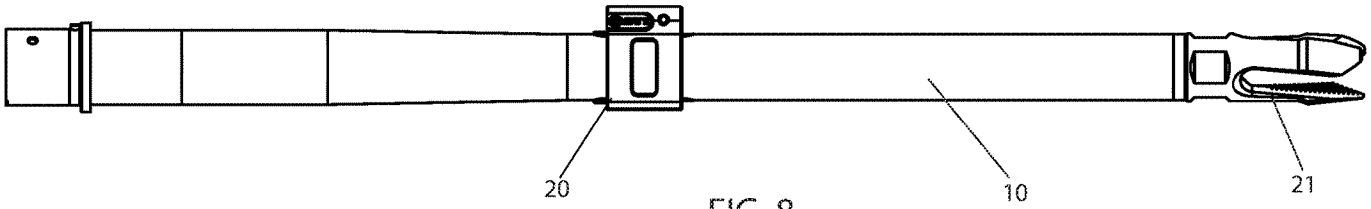
FIG. 8 is a side elevation of a completed gun barrel, with a gas block structure.
Figure 9:
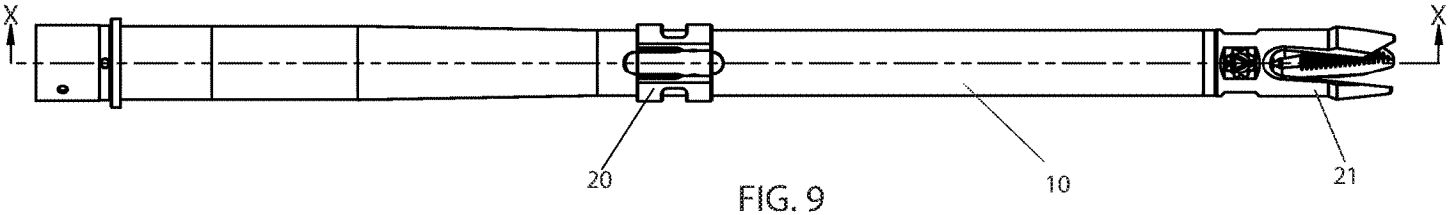
FIG. 9 is a top plan view of the completed gun barrel if FIG. 8.
Figure 10:
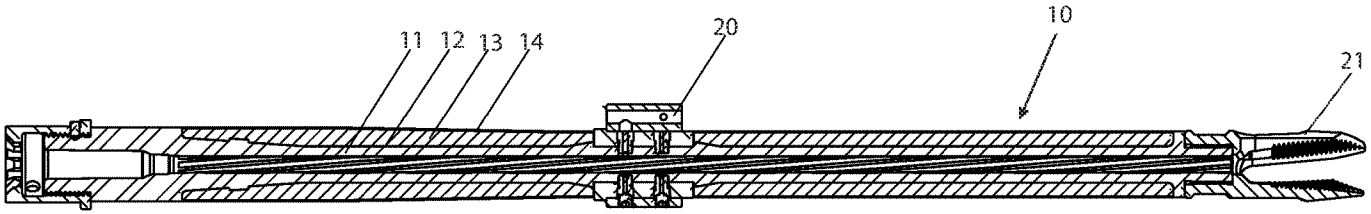
FIG. 10 sectional view of the completed gun barrel in FIG. 9, taken along line X.

A steel gas key insert 16 is then placed into the slots via mechanical or chemical procedure to provide a path for a highly pressurized gas from the fired cartridge to a pressure vessel to operate the firearm. This prevents gas leak into the composite. The gas key insert 16 may be joined to the liner 11 by using induction brazing. Other mechanical or chemical procedures such as laser, high-temperature adhesive and welding may be used to join the gas key insert 16 to the liner 11 (FIGS. 3 and 4 illustrate the use of mechanical fasteners 17). This step may be omitted if the gas keys were attached to the steel liner before wrapping a continuous fiber wrap. Finally, a gas port 18 is drilled through the gas key insert 16 to the center of a bore 19 of the rifled barrel. The barrel may then be fitted with a gas block 20 and utilized on a firearm, including with the use of other accessories like flash suppressor 21. (FIGS. 8-10).

This invention may be applicable to other technologies such as oil and gas explorations and harvesting, designing ladders, sports equipment, and motorsports.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A method of making a fiber wrapped firearm barrel utilizing a steel barrel liner; the method comprising:

first, applying a corrosion resistant coating to a steel barrel liner insert;

second, wrapping a composite, further comprising fiber in a resin matrix, onto the steel barrel liner, over the corrosion resistant coating, thereby forming a composite structure of steel and fiber which contains fibers which are not interrupted by the circumference of the steel liner;

then forming a at least one slot in the composite;

inserting a gas key into the at least one slot;

adhering the gas key to the steel barrel liner through the composite fibers;

creating a steel pathway for highly pressurized gas to a pressure vessel by drilling a gas port through the gas key to the center of the barrel;

wherein the gas key will then act as a solid platform to mount a pressure vessel to operate a firearm.

2. The method of claim 1, further comprising forming two slots in the composite structure and inserting gas keys into both slots and adhering them to the steel barrel liner.

3. The method of claim 2, the step of adhering the gas keys to the barrel being accomplished though brazing.

4. The method of claim 2, the step of adhering the gas keys to the barrel being accomplished by utilizing a fastening paradigm selected from the set of fastening paradigms consisting of laser welding, high-temperature adhesive, welding, and using at least one mechanical fastener.

5. The method of claim 1, the step of adhering the at least one gas key to the barrel being accomplished though brazing.

6. The method of claim 1, the step of adhering the gas key to the barrel being accomplished by utilizing a fastening paradigm selected from the set of fastening paradigms consisting of laser welding, high-temperature adhesive, welding, and using at least one mechanical fastener.

7. A method of making a non-segmented, continuous fiber wrapped firearm barrel utilizing a steel barrel liner; the method comprising:

first, wrapping a non-segmented composite, further comprising fiber in a resin matrix, onto the steel barrel liner, thereby forming a composite structure of steel and fiber which contains fibers which are not interrupted by the circumference of the steel liner;

then forming a at least one slot in the non-segmented composite;

inserting a gas key into the at least one slot;

adhering the gas key to the steel barrel liner through the composite fibers;

creating a steel pathway for highly pressurized gas to a pressure vessel by drilling a gas port through the gas key to the center of the barrel;

wherein the gas key will then act as a solid platform to mount a pressure vessel to operate a firearm.

8. The method of claim 7, further comprising forming two slots in the composite structure and inserting gas keys into both slots and adhering them to the steel barrel liner.

9. The method of claim 8, the step of adhering the gas keys to the barrel being accomplished though brazing.

10. The method of claim 8, the step of adhering the gas keys to the barrel being accomplished by utilizing a fastening paradigm selected from the set of fastening paradigms consisting of laser welding, high-temperature adhesive welding, and using at least one mechanical fastener.

11. The method of claim 7, the step of adhering the at least one gas key to the barrel being accomplished though brazing.

12. The method of claim 7, the step of adhering the gas key to the barrel being accomplished by utilizing a fastening paradigm selected from the set of fastening paradigms consisting of laser welding, high-temperature adhesive welding, and using at least one mechanical fastener.

13. A method of making a fiber wrapped firearm barrel utilizing a steel barrel liner; the method comprising:

applying a corrosion resistant coating to a steel barrel liner insert;

wrapping a composite, further comprising fiber in a resin matrix, onto the steel barrel liner, over the corrosion resistant coating, thereby forming a composite structure of steel and fiber which contains fibers which are not interrupted by the circumference of the steel liner;

forming two slots in the composite;

inserting a gas key into each slot;

adhering the gas keys to the steel barrel liner through the composite fibers;

creating a steel pathway for highly pressurized gas to a pressure vessel by drilling a gas port through at least one gas key to the center of the barrel;

wherein at least one gas key will then act as a solid platform to mount a pressure vessel to operate a firearm.

14. The method of claim 13, the step of adhering the gas keys to the barrel being accomplished though brazing.

15. The method of claim 13, the step of adhering the gas keys to the barrel being accomplished by utilizing a fastening paradigm selected from the set of fastening paradigms consisting of laser welding, high-temperature adhesive, welding, and using at least one mechanical fastener.

16. A method of making a non-segmented, continuous fiber wrapped firearm barrel utilizing a steel barrel liner; the method comprising:

wrapping a non-segmented composite, further comprising fiber in a resin matrix, onto the steel barrel liner, thereby forming a composite structure of steel and fiber which contains fibers which are not interrupted by the circumference of the steel liner;

forming two slots in the non-segmented composite;

inserting a gas key into each one slot;

adhering the gas keys to the steel barrel liner through the composite fibers;

creating a steel pathway for highly pressurized gas to a pressure vessel by drilling a gas port through at least one gas key to the center of the barrel;

wherein at least one gas key will then act as a solid platform to mount a pressure vessel to operate a firearm.

17. The method of claim 16, the step of adhering the gas keys to the barrel being accomplished though brazing.

18. The method of claim 16, the step of adhering the gas keys to the barrel being accomplished by utilizing a fastening paradigm selected from the set of fastening paradigms consisting of laser welding, high-temperature adhesive, welding, and using at least one mechanical fastener.

* * * * *